US010662708B2

(12) United States Patent
Snarr

(10) Patent No.: US 10,662,708 B2
(45) Date of Patent: May 26, 2020

(54) WINDOW WELL EGRESS APPARATUS

(71) Applicant: Daniel K. Snarr, Tooele, UT (US)

(72) Inventor: Daniel K. Snarr, Tooele, UT (US)

( * ) Notice: Subject to any disclaimer, the term of this patent is extended or adjusted under 35 U.S.C. 154(b) by 0 days.

(21) Appl. No.: 16/039,214

(22) Filed: Jul. 18, 2018

(65) Prior Publication Data

US 2019/0010759 A1 Jan. 10, 2019

Related U.S. Application Data

(63) Continuation-in-part of application No. 14/945,250, filed on Nov. 18, 2015, now abandoned.

(60) Provisional application No. 62/081,392, filed on Nov. 18, 2014.

(51) Int. Cl.

| | |
|---|---|
| ***E04F 17/06*** | (2006.01) |
| ***E06C 9/06*** | (2006.01) |
| ***E06C 9/10*** | (2006.01) |
| ***E06C 7/12*** | (2006.01) |
| ***E06C 1/34*** | (2006.01) |
| ***E06C 9/08*** | (2006.01) |

(52) U.S. Cl.

CPC ..... *E06C 9/10* (2013.01); *E04F 17/06* (2013.01); *E06C 1/34* (2013.01); *E06C 7/12* (2013.01); *E06C 9/08* (2013.01)

(58) Field of Classification Search

CPC ..... E06C 1/34; E06C 7/12; E06C 9/00; E06C 9/06; E06C 9/10; E06C 9/12; E06C 7/16; E06C 7/18; E06C 9/08; E04F 11/04; E04F 17/06; E05F 1/08; E05B 15/0093; A62B 3/00

USPC ..... 182/77, 78, 79, 80, 81

See application file for complete search history.

(56) References Cited

U.S. PATENT DOCUMENTS

| | | | | | |
|---|---|---|---|---|---|
| 527,852 | A * | 10/1894 | Grossé | E04F 11/062 | 182/81 |
| 3,046,613 | A | 7/1962 | Smith | | |
| 3,807,528 | A * | 4/1974 | Frank | E04D 13/035 | 182/81 |
| 3,896,595 | A * | 7/1975 | Anghinetti | E05C 3/12 | 52/19 |
| 3,946,833 | A * | 3/1976 | Riehlmann | E06C 9/08 | 182/20 |
| 3,999,334 | A * | 12/1976 | Webb | A62B 3/00 | 52/20 |
| 4,076,102 | A * | 2/1978 | Desarzens | E04F 11/066 | 182/81 |
| 4,180,142 | A * | 12/1979 | Sevillano | E04F 11/064 | 182/196 |
| 4,222,458 | A * | 9/1980 | Pratt | E06C 9/08 | 182/81 |
| 4,476,957 | A * | 10/1984 | Ory | E06C 9/10 | 182/195 |
| 4,495,728 | A * | 1/1985 | Lynn | E06C 9/10 | 49/141 |
| 5,205,073 | A * | 4/1993 | Lyons, Sr. | E02D 29/1418 | 49/379 |

(Continued)

*Primary Examiner* — Daniel P Cahn

(74) *Attorney, Agent, or Firm* — Dax D. Anderson; Kirton McConkie

(57) ABSTRACT

This is a system that allows a small child to escape from a window well using a ladder and a window well cover. The ladder extends from the bottom of the window well cover and has a trigger that when activated slides the ladder and releases a trap door in the window well cover, thus allowing a person to climb the ladder and escape through the cover.

8 Claims, 15 Drawing Sheets

(56) References Cited

U.S. PATENT DOCUMENTS

| | | | | |
|---|---|---|---|---|
| 8,091,292 | B1 | 1/2012 | Jalbert | |
| 2010/0031573 | A1* | 2/2010 | Whiting | E05B 47/02 49/31 |
| 2011/0203194 | A1* | 8/2011 | Kelsch | E04F 17/06 52/69 |
| 2016/0138337 | A1* | 5/2016 | Snarr | E06C 1/34 182/129 |
| 2019/0226280 | A1* | 7/2019 | Rogers, III | E06C 9/10 |

* cited by examiner

WINDOW WELL EGRESS APPARATUS

CROSS-REFERENCE TO RELATED APPLICATIONS

This application is a continuation-in-part of U.S. patent application Ser. No. 14/495,250, filed Nov. 18, 2015, entitled "Window Well Egress Apparatus," which is incorporated herein in its entirety; which claims benefit of U.S. Provisional Patent Application No. 62/081,392, filed Nov. 18, 2014.

TECHNICAL FIELD

The present disclosure relates generally to a cover for a window well and an egress ladder. More particularly, the disclosure relates to a window well cover that combines a ladder and mechanically driven systems to create an opening in the window well cover to allow for egress.

BACKGROUND

Modern building code dictates that every habitable bedroom in a dwelling must have an egress window. While the primarily objective is to allow occupants of the dwelling to escape in the event of an emergency, it also creates an access point for emergency workers to easily enter the dwelling. Furthermore, a window improves the quality of living by providing ample sunlight and ventilation in the basement living areas.

As dwellings have expanded and basements have become more prevalent, homebuilders are incorporating more basement bedrooms into their designs. To maximize subsurface living space while also conforming to the building code, builders must include basement windows. Consequently, window wells must be constructed around the windows to create an opening and retain the surrounding soil.

Although the need for window wells is predicated on building safety, their presence also creates an inherent safety and security hazard. First, in essence a window well is an exposed "well" that an individual can fall into. This safety concern is of particular relevance for small children. Second, window wells and subsurface windows create an easy and relatively concealed access point for intruders to enter the dwelling.

BRIEF SUMMARY

The general purpose of the systems and methods disclosed herein is to provide an improved window well cover that addresses the safety and security concerns of an exposed well, while also promoting easy egress from within the well. Specifically, the window well egress apparatus will aid smaller individuals who would otherwise be unable to remove the well cover. The overall apparatus contains two major components, a cover grate with a selectively movable subsection and a ladder system that allows a user to access and egress through the opening created by the selectively movable subsection in the grate. This apparatus is designed to work in conjunction with a variety of existing window well structures, but it could also be included in conjunction with a new window well structure.

In one non-limiting embodiment, the apparatus comprises a window well cover grate with a subsection that can slide independently of the remaining gate. A mechanical system is also included to exert a force upon the sliding subsection, operable to slide the subsection linearly and create an opening in the cover grate. The mechanical system comprises a cable, pulley and weight, which work collectively to apply an opening force on the subsection of the grate.

A ladder system is also included in the embodiment and serves two purposes. First it allow smaller individual to exit the well, and second it interlocks with the sliding subsection of the grate. The ladder system comprises a ladder frame, a sliding ladder section, and a means of connecting the ladder section to the ladder frame. The sliding ladder section further includes at least one catch peg that interlocks with the sliding subsection of the grate to restrict movement. A mechanical system is utilized to maintain contact between the sliding section of the grate, and the catch pegs attached to the sliding section of the ladder. The mechanical system comprises a pulley, a cable and weight to exert a force upon the sliding section of the ladder.

In one alternative embodiment, the ladder system includes several members that interface with the side wall of the window well. These members provide a uniform base for the ladder frame and maintain the upright position of the ladder. Furthermore, the members allow the cover grate to be removed independently of the ladder system.

In an emergency, an individual merely applies weight to or adjacent to the sliding ladder section. This applied weight exceeds the force applied by the mechanical system and the ladder descends down the ladder frame. This movement causes the catch pegs to disconnect, which allows for movement of the sliding grate subsection and creates an opening.

In another non-limiting embodiment, the apparatus comprises a window well cover grate with a subsection that can slide independently of the remaining gate. A mechanical system is also included to exert a force upon the sliding subsection, operable to slide the subsection linearly and create an opening in the cover grate. The mechanical system comprises one or more springs, which work collectively to apply an opening force on the subsection of the grate.

A ladder system is also included in the embodiment and serves two purposes. First it allow smaller individual to egress and exit the well, and second it also interlocks with the sliding subsection of the grate. The ladder system comprises a ladder frame, a sliding ladder section, and a means of connecting the ladder section to the ladder frame. The sliding ladder section further includes at least one catch peg that interlocks with the sliding subsection of the grate to restrict movement. A mechanical system is utilized to maintain contact between the sliding section of the grate, and the catch pegs attached to the sliding section of the ladder. The mechanical system comprises one or more springs to exert a force upon the sliding section of the ladder.

In one embodiment, the ladder system includes several members that interface with the side wall of the window well. These members provide a uniform base for the ladder frame and maintain the upright position of the ladder. Furthermore, the members allow the cover grate to be removed independently of the ladder system.

In an emergency, an individual merely applies weight to or adjacent to the sliding ladder section. This applied weight exceeds the force applied by the mechanical system and the ladder descends down the ladder frame. This movement causes the catch pegs to disconnect, which allows movement of the sliding grate subsection and creates an opening.

In some embodiments, a window well egress apparatus may include a main grate having a moveable subsection. In some embodiments, the window well egress apparatus may include a ladder. In some embodiments, the ladder may include a stationary section, which may be coupled to the main grate, and a sliding section. In some embodiments, the stationary section may include a fulcrum. In some embodiments, the sliding section may slide with respect to the stationary section. In some embodiments, the sliding section may include a catch element.

In some embodiments, the window well egress apparatus may include a counterweight element pivotally coupled to the sliding section and supported by the fulcrum. In some embodiments, in response to a downward force being applied to the sliding section of the ladder, the catch element may be lowered and the moveable subsection may open.

In some embodiments, the sliding section may include a slide bracket. In some embodiments, the stationary section may extend through the slide bracket. In some embodiments, the sliding section may include a rung. In some embodiments, the counterweight element may include a rung bracket. In some embodiments, the rung of the ladder may extend through the rung bracket and the counterweight element may pivot around the rung. In some embodiments, the counterweight element may include a weight and a plate. In some embodiments, the weight may be separated from the rung bracket by the plate. In some embodiments, the plate may sit on top of the fulcrum. In some embodiments, the plate may be generally planar.

In some embodiments, in response to the downward force being applied to the sliding section of the ladder, the weight may move upwardly. In some embodiments, in response to the downward force being removed, the sliding section of the ladder may return to a raised position. In some embodiments, the stationary section may further include a support structure, which may extend outwardly from the stationary section away from the sliding section. In some embodiments, the fulcrum may be coupled to the support structure.

In some embodiments, the ladder may be coupled to the main grate. In some embodiments, the sliding section of the ladder may be slidable between a raised position and a lowered position. In some embodiments, in response to the sliding section sliding to the lowered position, the main grate may be opened. In some embodiments, the ladder may include the stationary section, which may be coupled to the main grate. In some embodiments, the sliding section may slide along the stationary section.

In some embodiments, the sliding section may extend above a lower edge of the moveable subsection when the sliding section is in the raised position to prevent the moveable subsection from opening. In some embodiments, when the sliding section is in the lowered position, the sliding section may be disposed below the lower edge of the moveable subsection to allow the moveable subsection to open.

Reference throughout this specification to features, advantages, or similar language does not imply that all of the features and advantages that may be realized with the present invention should be or are in any single embodiment of the invention. Rather, language referring to the features and advantages is understood to mean that a specific feature, advantage, or characteristic described in connection with an embodiment is included in at least one embodiment of the present invention. Thus, discussion of the features and advantages, and similar language, throughout this specification may, but do not necessarily, refer to the same embodiment, but may refer to every embodiment.

Furthermore, the described features, advantages, and characteristics of the invention may be combined in any suitable manner in one or more embodiments. One skilled in the relevant art will recognize that the invention may be practiced without one or more of the specific features or advantages of a particular embodiment. In other instances, additional features and advantages may be recognized in certain embodiments that may not be present in all embodiments of the invention.

The features and advantages of the present invention will become more fully apparent from the following description and appended claims, or may be learned by the practice of the invention as set forth hereinafter.

BRIEF DESCRIPTION OF THE DRAWINGS

In order to describe the manner in which the advantages and features of the invention can be obtained, a more particular description of the invention briefly described above will be rendered by reference to specific embodiments thereof which are illustrated in the appended drawings. Understanding that these drawings depict only typical embodiments of the invention and are not therefore to be considered to be limiting of its scope, the invention will be described and explained with additional specificity and detail through the use of the accompanying drawings in which.

DETAILED DESCRIPTION OF THE INVENTION

The present embodiments of the present invention will be best understood by reference to the drawings, wherein like parts are designated by like numerals throughout. It will be readily understood that the components of the present invention, as generally described and illustrated in the figures herein, could be arranged and designed in a wide variety of different configurations. Thus, the following more detailed descriptions of the embodiments of the apparatus, as represented in FIGS. 1A-C, 2, 3A-C, 4-5C, and 6A-6I are not intended to limit the scope of the invention, as claimed, but are merely representative of present embodiments of the invention.

In general, the figures disclose an invention that provides a window well cover egress apparatus that can be used to safely cover an exposed window well, while also providing for a safe and easy egress from within the well. The window well egress apparatus of the disclosed invention is especially beneficial for small individuals, who otherwise would be unable to reach the window well cover from within the well. Larger individuals may simply lift and remove the entire cover grate and use the ladder independently.

In the following description, numerous references will be made to windows, window wells and window well structures, but these items are not shown in detail in the figures. However, it should be understood that one of ordinary skill in the art and in possession of this disclosure, would readily understand how the present invention and existing windows, window wells and window wells structures can be incorporated.

Figure 1A:
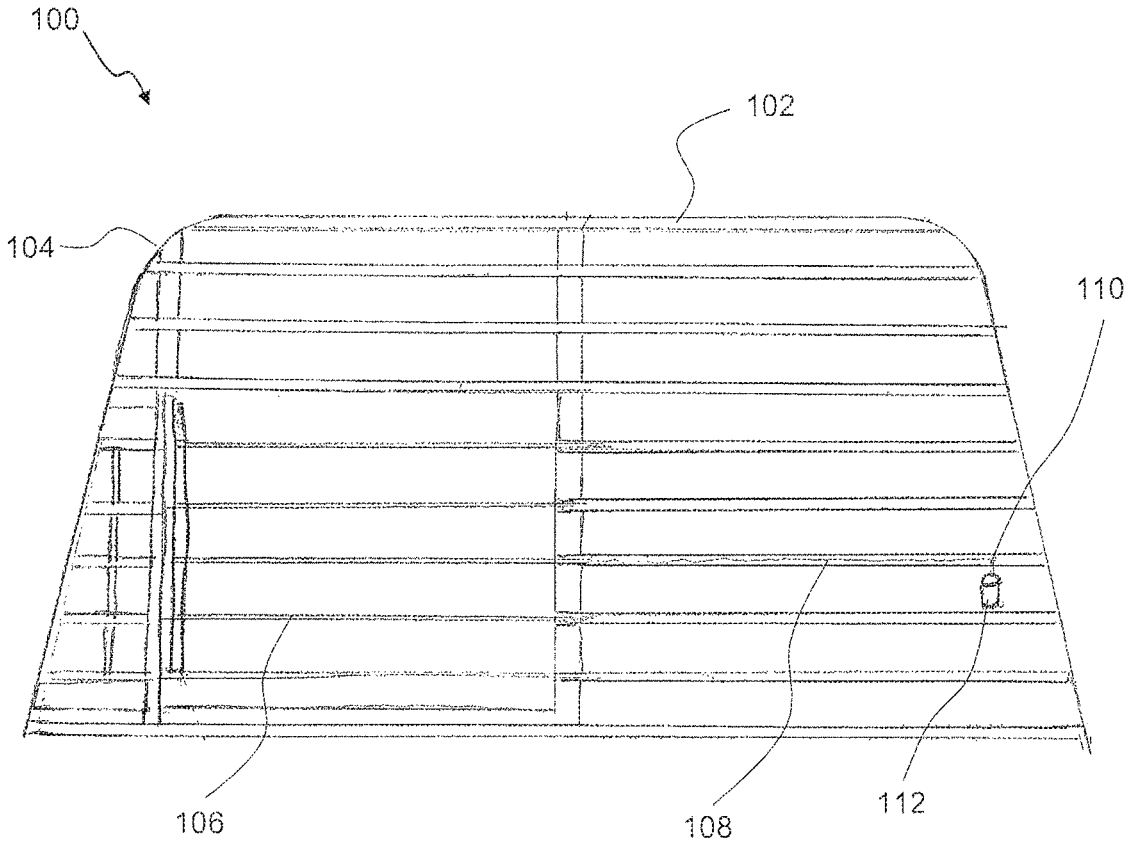
FIG. 1A shows a detailed plan view of the window well cover with a sliding subsection. The drawing also illustrates a pulley, cable and weight that are used to exert a force on the sliding section of the grate.
Figure 1B:
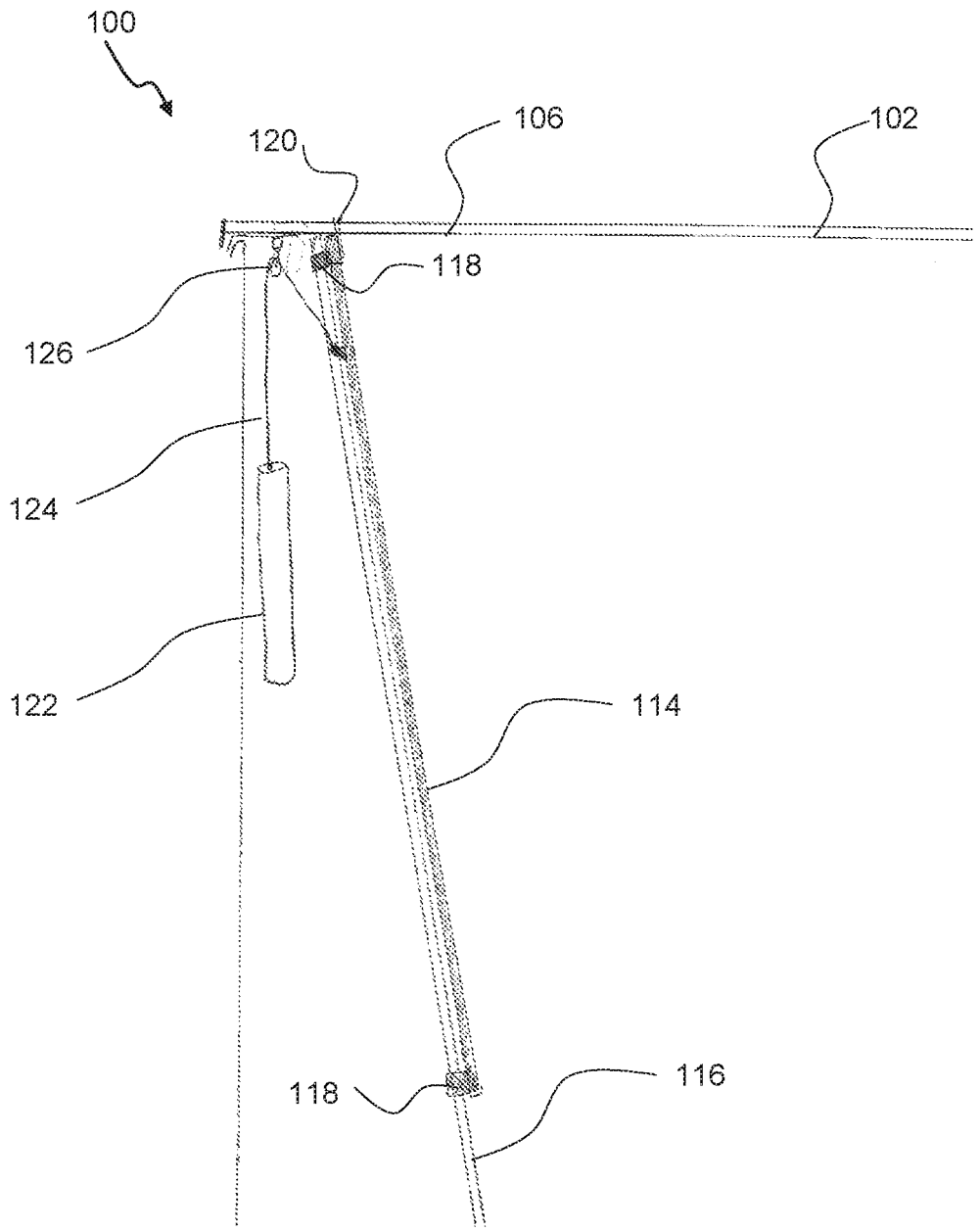
FIG. 1B shows a detailed side view of the window well cover and ladder mechanism. The drawing also illustrates a pulley, cable and weight that are used to exert a force on the sliding section of the ladder.
Figure 1C:
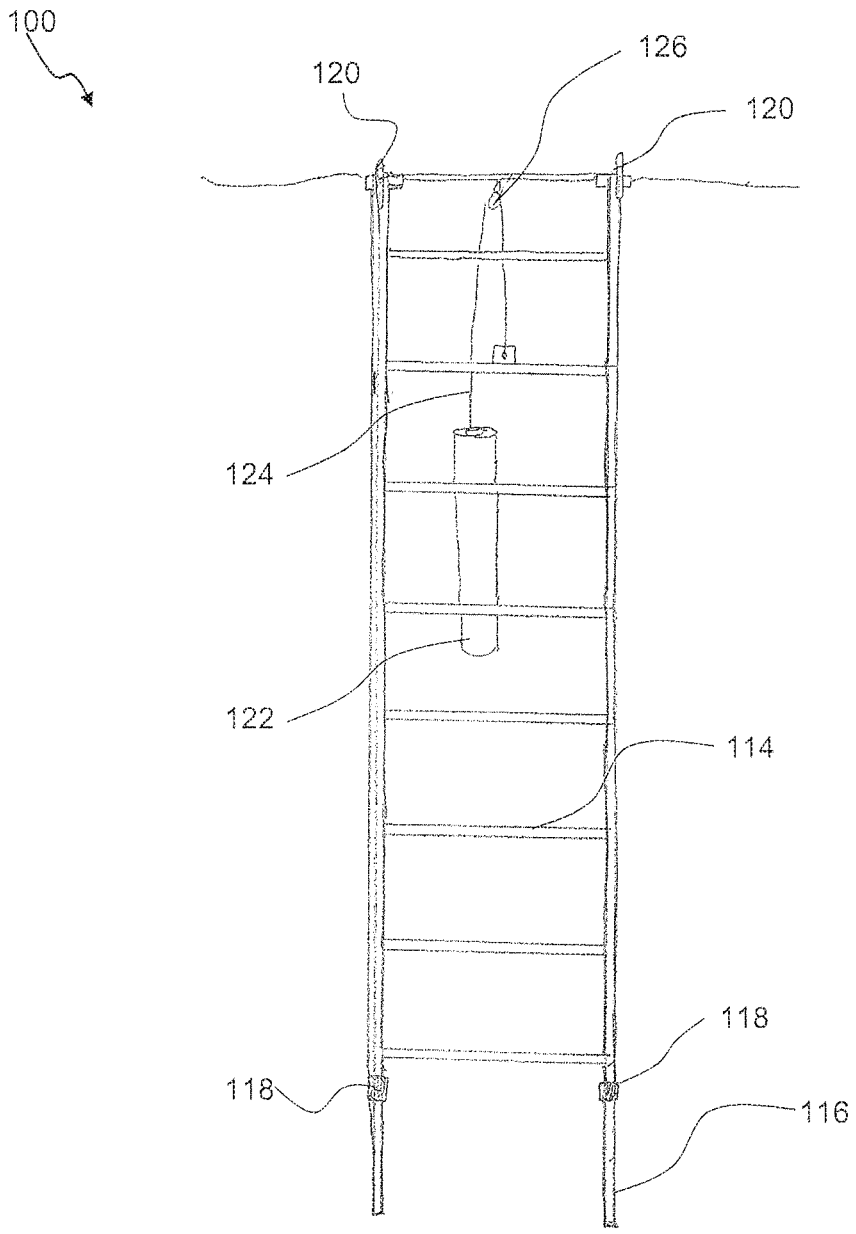
FIG. 1C shows a detailed front perspective view of the ladder mechanism. The figure also illustrates a pulley, cable and weight that are used to exert a force on the sliding section of the ladder.
Figure 2:
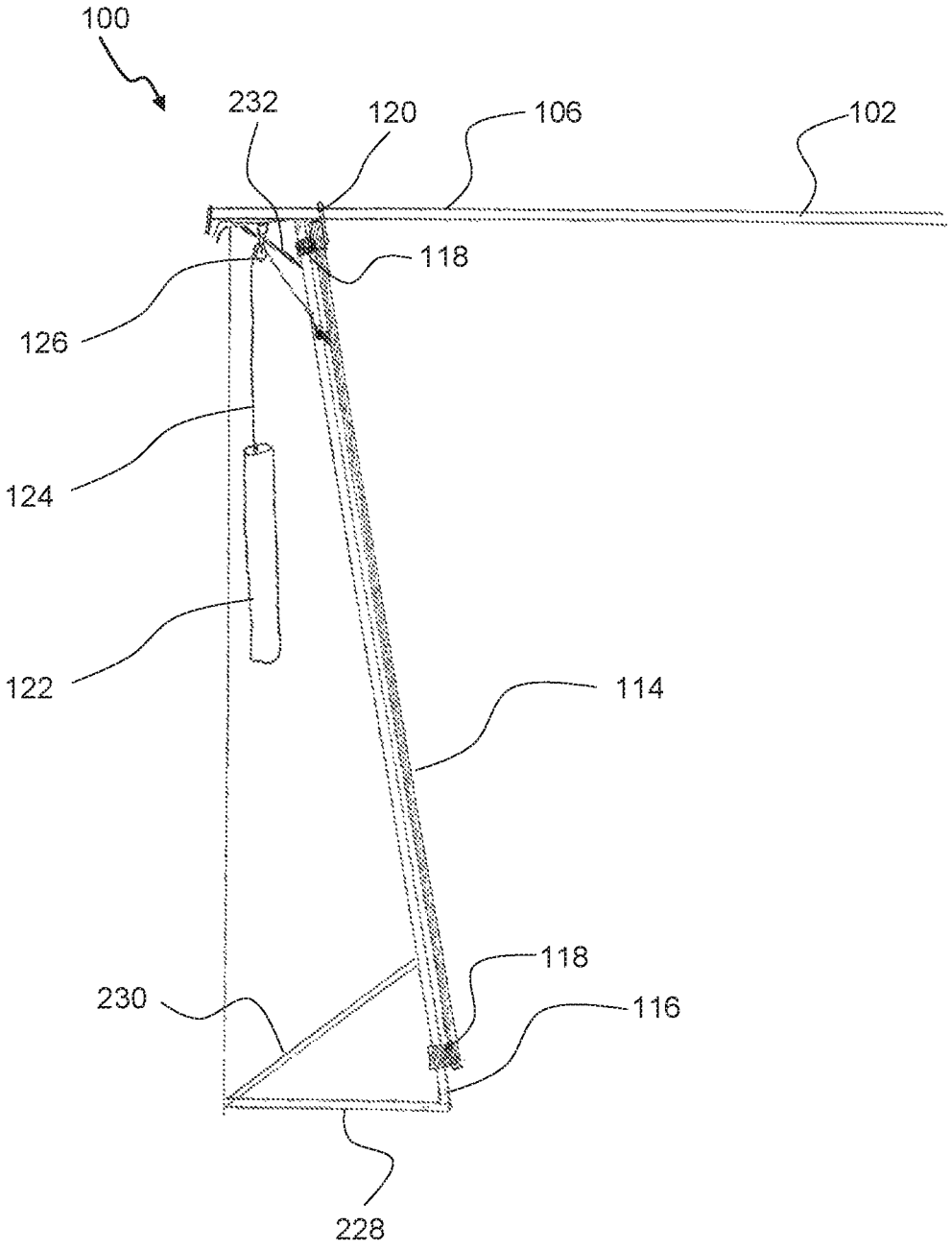
FIG. 2 shows an embodiment of the invention where several members are used to maintain the ladder in an upright position. The figure also illustrates the pulley, cable and weight that are used to exert a force on the sliding section of the ladder.

Detailed references will now be made to the preferred embodiments of the present invention, examples of which are illustrated in FIGS. 1A-C. FIGS. 1A-C illustrate various views of a window well egress apparatus 100 in accordance with one or more embodiments of the invention.

A plan view of the overall apparatus is shown in FIG. 1A. The apparatus 100 of FIG. 1A includes a main grate 102 of no particular size or shape, but is fabricated to completely cover and rest upon a window well structure 104. Within the main grate 102, is a subsection 106 that can move independently of the remaining grate 102. Generally, the subsection may comprise a sliding subsection 106 with an open and closed position. Alternative embodiments may comprise a swinging door, a trap door, a lift and slide door, folding door, a roll-away door, or any other mechanism that would allow the subsection to open to allow egress through the main grate 102. Accordingly, when the sliding section 106 is in the closed position it works in conjunction with the main grate 102 to create a uniform window well cover. Conversely, when the sliding section 106 is in the open position, an individual may exit the grate through the created opening.

The movement of the sliding section 106 is driven by a potential energy source. In some embodiments a cable 108, a pulley 110 and a weight 112. Collectively, these items are assembled to exert an opening force on the sliding section 106. Generally, under the influence of gravity the weight will descend and exert a force on the cable 108. The pulley 110 translates the vertical force of the descending weight into a horizontal force and pulls the sliding section 106 open. Under the influence of the weight, the sliding section's 106 default position is open, and energy must be exerted to close the sliding section 106. In alternative embodiments the potential source may comprise electrical energy such as a battery or power from the grid may be used to activate and actuate the subsection.

As shown in FIG. 1B-1C, the invention also discloses a ladder system that provides a means for individuals to exit the window well. The ladder system includes a sliding ladder section 114 that is attached to a ladder frame 116 using slide brackets 118. In addition to its functional use in assisting egress, the ladder also serves as a mechanism to restrict the movement of the sliding section 106, and as a trigger to release the sliding section 106 to create an opening. The sliding ladder section 114 has catch pegs 120 that interlock with the sliding section of the grate 106. While the catch pegs 120 and sliding section 106 are interlocked, the sliding section of the grate 106 remains in the closed position.

The ladder system also utilizes a weight 122, a cable 124 and a pulley 126 to cause an interaction with the sliding section of the grate 106. Generally, under the influence of gravity the weight 122 will descend and exert a force on the cable 124. The pulley 126 translates the downward vertical force of the descending weight into an upward vertical force and pulls the sliding section of the ladder 114 upward. Under the influence of the weight 122, the ladder sliding section's 114 default position is up which creates contact with the sliding section of the grate 106.

However, when an individual exerts weight on or near the sliding section of the ladder 114, the force exceeds the force of the weight 122 holding the ladder up and the ladder section 114 slides downward on the ladder frame 116. As the ladder section 114 moves downward, the catch pegs 120 lose contact with the sliding section of the grate 106. Without the pegs to restrict the movement of the sliding section of the grate 106, the weight drops 112 and the sliding section of the grate 106 opens.

The ladder system is not attached to the main grate so larger individuals may simply remove the entire main grate 102, and use the ladder 114 to exit the well.

In one embodiment, the ladder system further comprises one or more members to provide stability and maintain the ladder system in an upright position. These members are depicted in conjunction with the ladder system in FIG. 2. One or more horizontal base members 228 are attached near the bottom of the ladder frame 116. The horizontal base members 228 provide a uniform contact surface with the ground, and may interface with the window well side wall.

A sloping member 230 is also included to improve the rigidity between the ladder frame 116 and the horizontal base member 228. Finally, an additional sloping member 232 is attached to the ladder frame 116 near the top of the window well wall. The sloping member 232 maintains the horizontal position of the ladder frame 116, and allows for the ladder frame 116 to maintain its position if the cover grate 102 is removed. The base member 228, bottom sloping member 230, and top sloping member 232 work in conjunction to maintain the ladder at an angle between 45 and 90 degrees with the ground surface.

In another embodiment, the apparatus utilizes springs to apply the requisite forces. A plan view of the overall apparatus is shown in FIG. 2A. The apparatus 300 of FIG. 2A includes a main grate 302 of no particular size or shape, but is fabricated to completely cover and rest upon a window well structure 304. Within the main grate 302, is a sliding section 306 that can move independently of the remaining grate 302. Generally, this sliding section 306 has an open and closed position. Accordingly, when the sliding section 306 is in the closed position in works in conjunction with the main grate 302 to create a uniform window well cover. Conversely, when the sliding section 306 is in the open position, an individual may exit the grate through the created opening.

The movement of the sliding section 306 is driven by one or more mechanical springs 308. Collectively, these springs are assembled to exert an opening force on the sliding section 306. Generally, under the influence of the springs 308 the sliding section's 306 default position is open and energy must be exerted to close the sliding section 306. The springs may apply a tension, compression, or torsion force to open the sliding section of the grate 306.

Figure 3A:
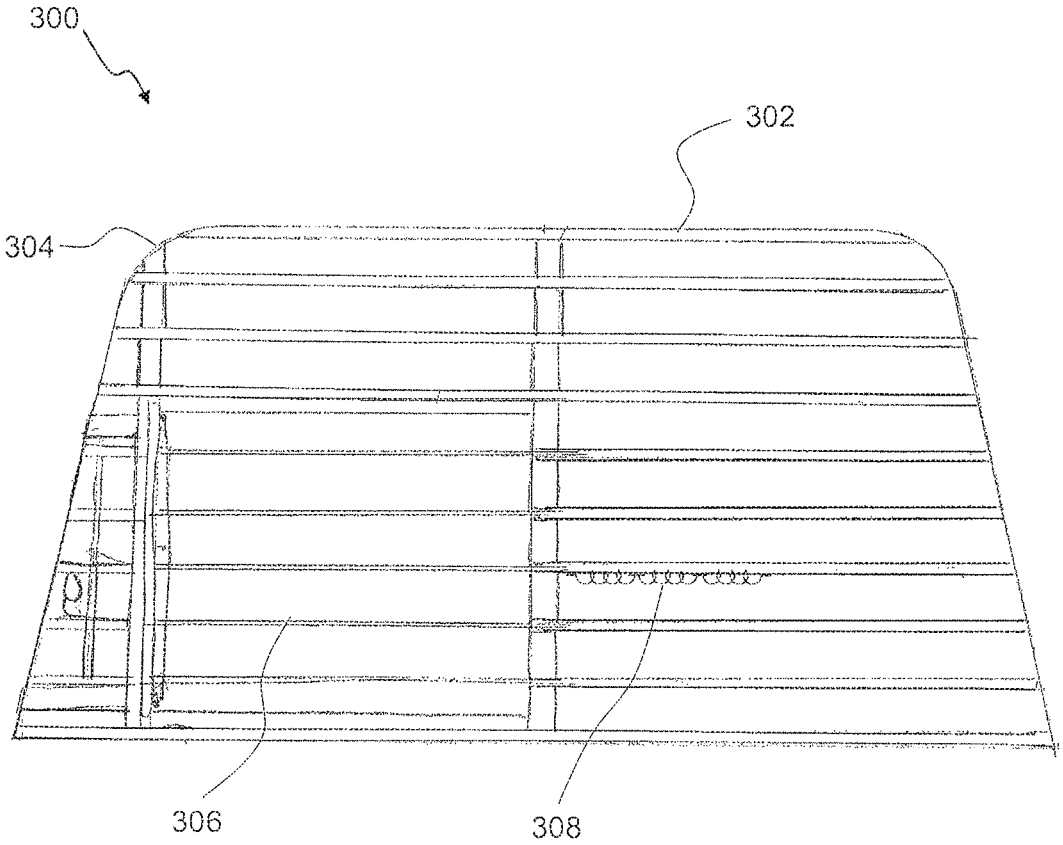
FIG. 3A shows a detailed plan view of the window well cover with a sliding subsection. The drawing also illustrates a spring that is used to exert a force on the sliding section of the grate.
Figure 3B:
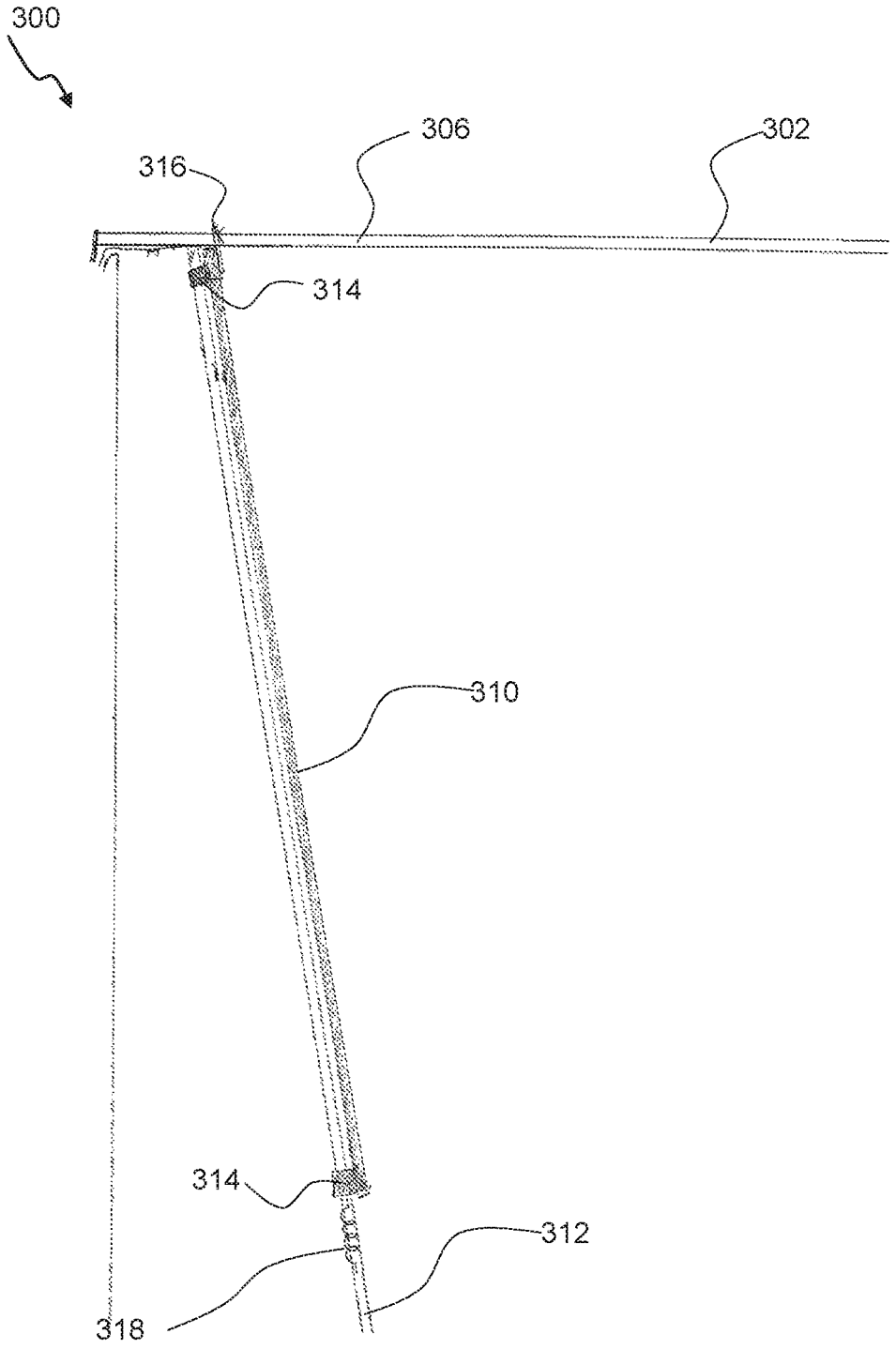
FIG. 3B shows a detailed side view of the window well cover and ladder mechanism. The figure also illustrates a spring that is used to exert a force on the sliding section of the ladder.
Figure 3C:
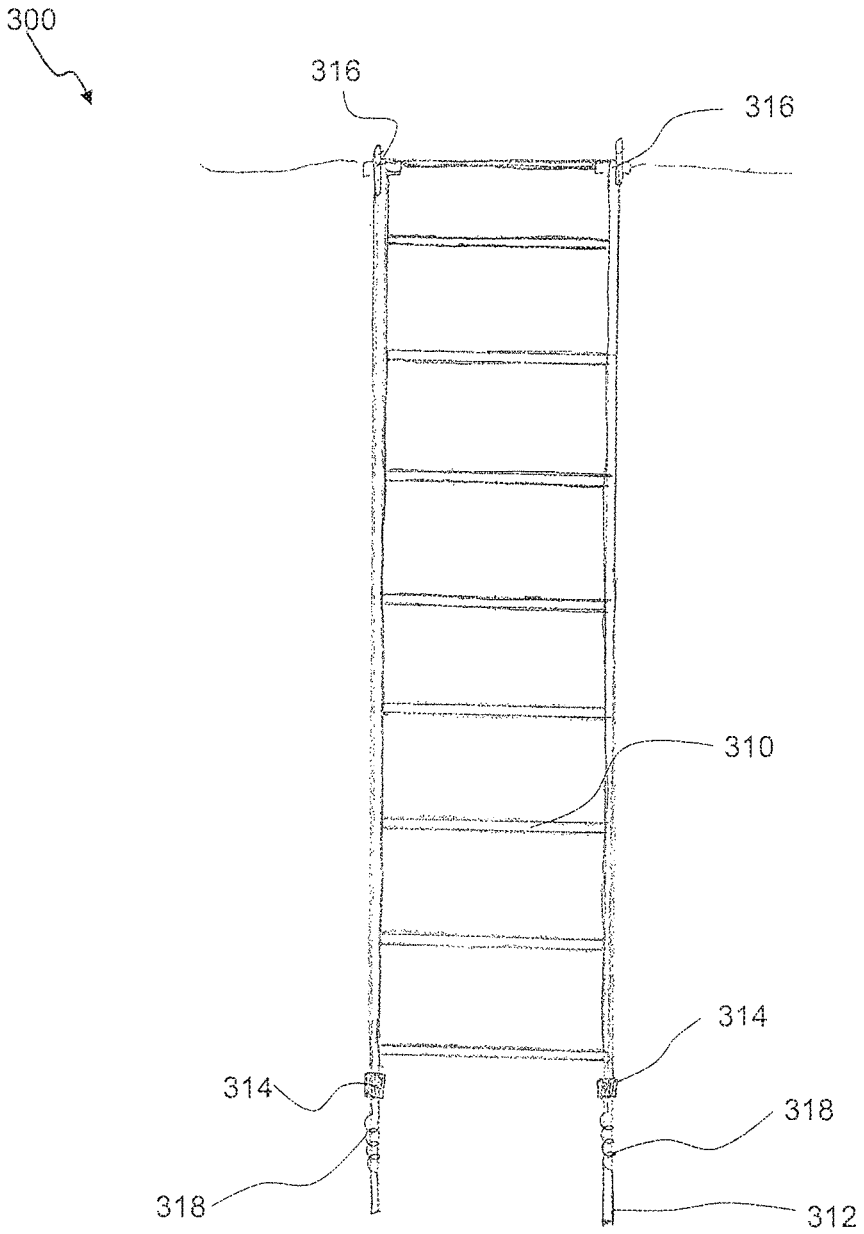
FIG. 3C shows a detailed front perspective view of the ladder mechanism. The drawing also illustrates a spring that is used to exert a force on the sliding section of the ladder.
Figure 4:
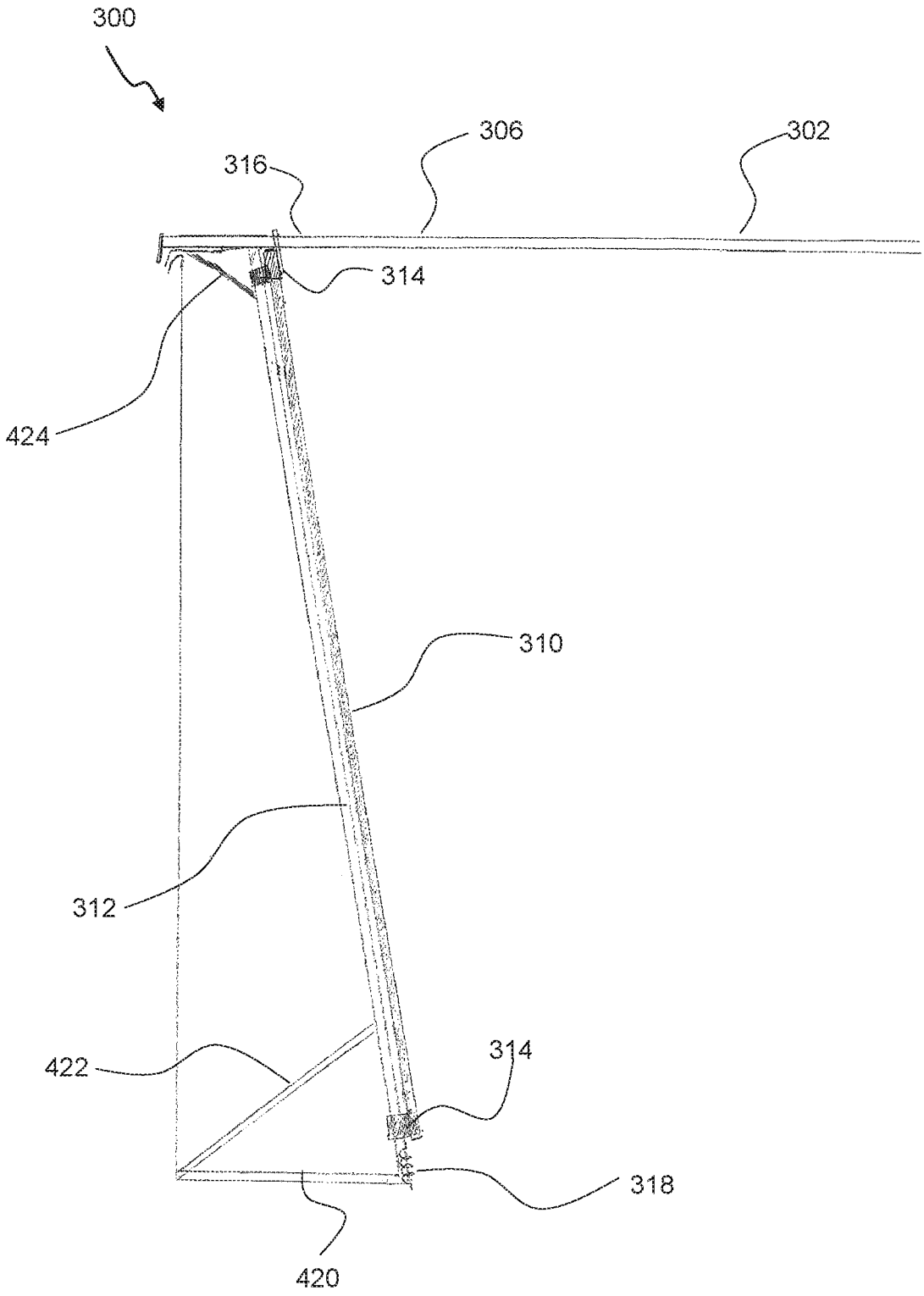
FIG. 4 shows an embodiment of the invention where several members are used to maintain the ladder in an upright position. The figure also illustrates the springs that are used to exert a force on the sliding section of the ladder.

As shown in FIG. 3B-3C, the invention also discloses a ladder system that provides a means for individuals to exit the window well. The ladder system includes a sliding ladder section 310 that is attached to a ladder frame 312 using slide brackets 314. In addition to its functional use in assisting egress, the ladder also serves as a restraint to the sliding section 306 and a trigger to release the sliding section 306 to create an opening. The sliding ladder section 310 has catch pegs 316 that interlock with the sliding section of the grate 306. While the catch pegs 316 and sliding section 306 are interlocked, the sliding section 306 of the grate remains in the closed position.

The ladder system utilizes one of more springs 318 to cause interaction with the sliding section of the grate 306. Generally, under the influence of the springs 318, the ladder sliding section's 310 default position is up which creates contact with the sliding section of the grate 306.

However, when an individual exerts weight on or near the sliding section of the ladder 310. The force exceeds the force of the springs 318 forcing the ladder section 310 up and the ladder sections 310 slides downward on the ladder frame 312. As the ladder section 310 moves downward, the catch pegs 316 lose contact with the sliding section of the grate 306. Without the pegs 316 to restrict the movement of the sliding section of the grate 306, the springs 308 cause the sliding section of the grate 306 to open.

The ladder system is not attached to the main grate so larger individuals may simply remove the entire main grate 302, and use the ladder 310 to exit the well.

In one embodiment, the ladder system further comprises one or more members to provide stability and maintain the ladder system in an upright position. These members are depicted in conjunction with the ladder system in FIG. 4. One or more horizontal base members 420 are attached near the bottom of the ladder frame 312. The horizontal base members 420 provide a uniform contact surface with the ground, and may interface with the window well side wall. A sloping member 422 is also included to improve the rigidity between the ladder frame 312 and the horizontal base member 420. Finally, an additional sloping member 424 is attached to the ladder frame 312 near the top of the window well wall. The sloping member 420 maintains the horizontal position of the ladder frame 312, and allows for the ladder frame 312 to maintain its position if the cover grate 302 is removed. The base member 420, bottom sloping member 422, and top sloping member 424 work in conjunction to maintain the ladder at an angle between 45 and 90 degrees with the ground surface.

Figure 5:
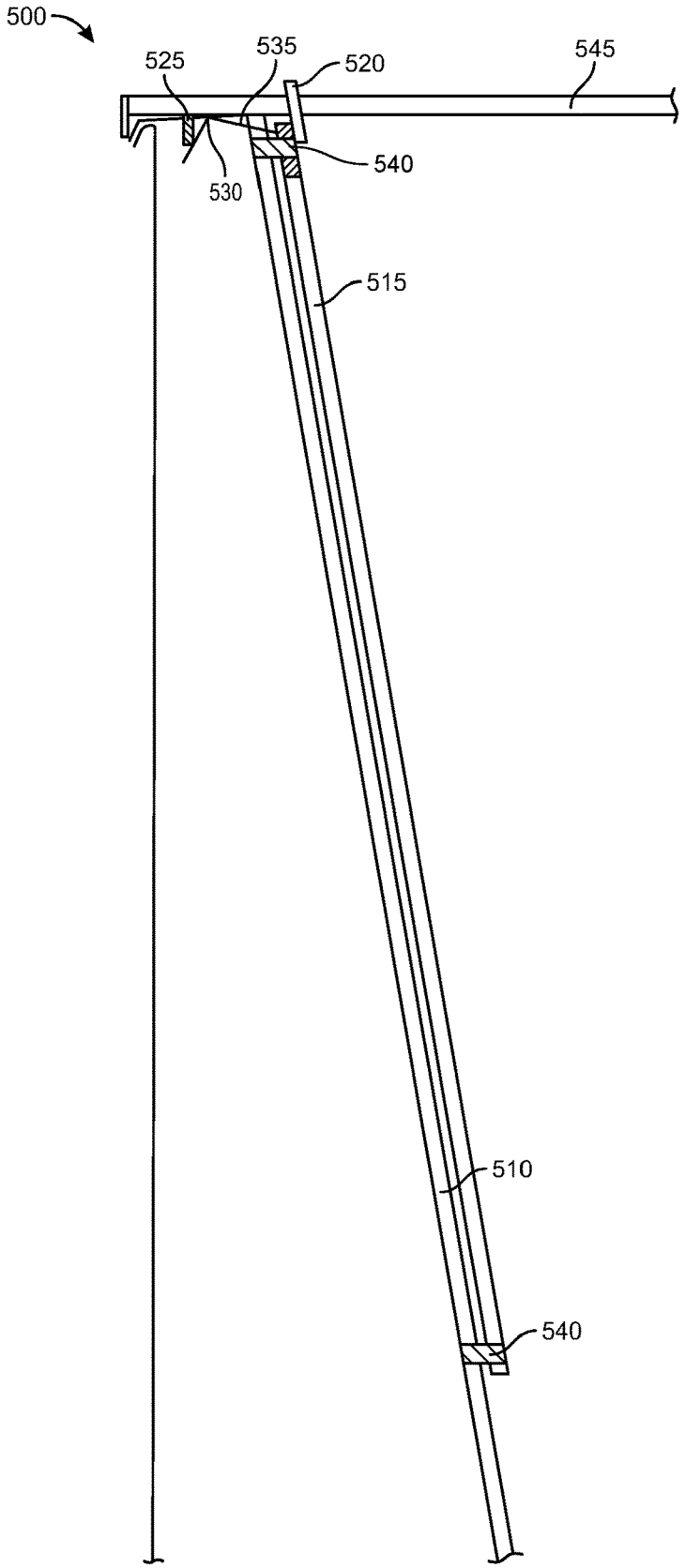
FIG. 5 shows an alternative embodiment of an egress ladder.
Figure 5A:
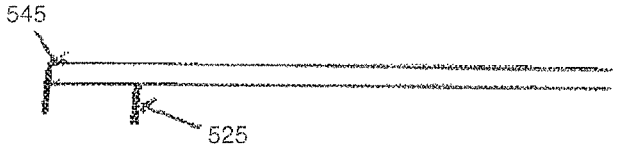
FIG. 5A shows the main grate with a push block.
Figure 5B:
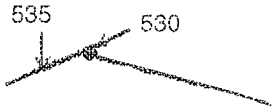
FIG. 5B shows the lift lever with the fulcrum.
Figure 5C:
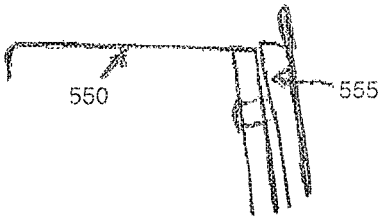
FIG. 5C shows the ladder frame with the sliding section of the ladder.

FIGS. 5-5C disclose an alternative embodiment of the window well egress apparatus 500. In this embodiment the ladder frame 510 extends from the main grate 545. A sliding section of the ladder 515 is integrated into the ladder frame 510 to permit the ladder to actuate the catching mechanism when the ladder is weighted. In this embodiment the weight of the grate 545 replaces the weight 112 and cable 108 of other embodiments. The main grate 545 further comprises a push block 525 and is integrated into the main grate 545. When the main grate 545 is placed upon the ladder apparatus 510, 515, the fulcrum lever 530 activates the lift lever 535 and lifts the sliding section of the ladder 515 through the slide brackets 535 engaging the catch pegs 520. FIG. 5C shows the attachment point for the fulcrum 550 as well as the contact point for the lever 555.

Referring now to FIGS. 6A-6I, another window well egress apparatus 600 is illustrated, according to some embodiments. In some embodiments there are three main components to the egress apparatus 600, a stationary section 602 which may comprise a ladder frame; a sliding section 604 which may comprise a ladder; and a main grate 606. In some embodiments the stationary section 602 is substantially immobile. In some embodiments the sliding section 604 ladder slides up and down on the stationary section 602 ladder frame. In some embodiments the main grate 606 has a moveable section 608 which can move to allow a person to pass through the grate.

In some embodiments the egress apparatus comprises a first position wherein the sliding section 604 ladder is in a raised position the top of the sliding section blocking the movable section from moving, thus the main grate 606 is in a closed position.

In some embodiments the egress apparatus comprises a second position wherein the sliding section is in a lowered position, the top of the sliding section not blocking the movable section from moving, thus the movable subsection 608 of the main grate 606 can be moved to an open position.

In some embodiments a trigger may be used to control when the sliding section 604 moves from its raised position to its lower position. In some embodiments the trigger may be any trigger known in the art. In some embodiments the trigger may be a notch and tongue trigger which releases upon being moved. In some embodiments the trigger may be a friction trigger wherein the structure of the sliding mechanism 604 is too tight to freely slide past the stationary section 602 without additional force. In some embodiments the trigger mechanism may be a spring. In some embodiments the trigger mechanism may have a trigger which is actuated when it is squeezed.

In some embodiments the sliding section 604 is held in the raised position by a trigger comprising a cantilever weight plate 616 that is hingedly coupled on a first end to the sliding section 604 and the weight is suspended on a second end; the plate freely pivots on the fulcrum 618. In a first raised position the force created by the weight of the cantilever is greater than the force created by the weight of the sliding section 604 ladder. At the top of the sliding section 604 are catch members 610 which secure a moveable section 608 of the main grate in a closed position. Thus in some embodiments the first position may comprise the sliding section 604 in a raised position restraining movement of the moveable section 608.

In some embodiments there is a second position. This occurs as additional force is added to the force of the sliding section so that the downward force on the sliding section is greater than the force created by the weight on the cantilever. This additional weight causes the sliding section 604 to a lowered position, the cantilever to pivot on the fulcrum 618, raising the weight and lowering the sliding section. In some embodiments the sliding section in the lowered position moves the catch elements 610 away from the moveable section 608 of the main grate 606, freeing the moveable section 608 to move from a closed position to an open position. The movement of the moveable section 608 from the closed position may be automatic (by a bias force such as springs, weights etc) or it may be manual. Thus in some embodiments the second position may comprise the sliding section 604 in a lowered position and the moveable section 608 unrestrained and capable of being moved to an open position.

Figure 6A:
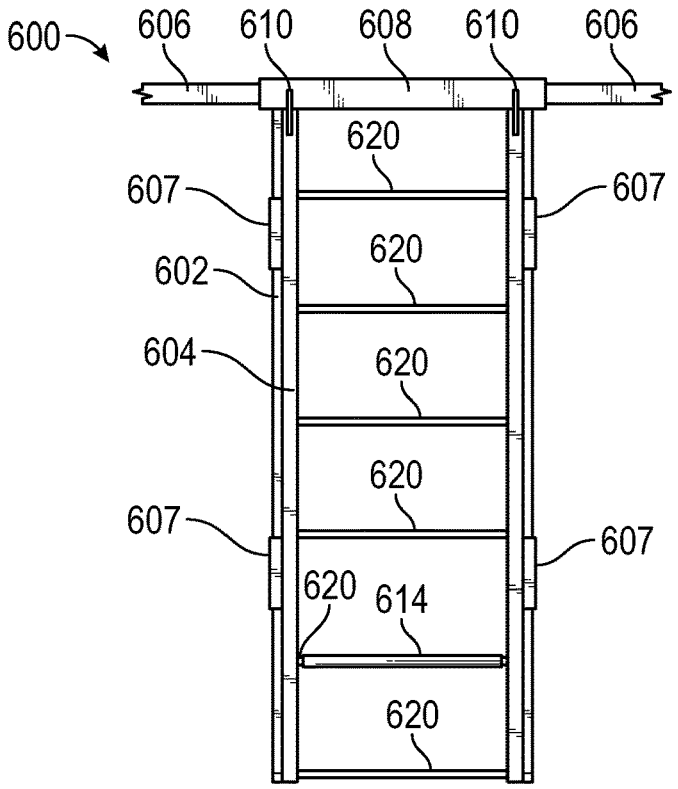
FIG. 6A is a front view of another example window well egress apparatus, according to some embodiments.

In some embodiments, the window well egress apparatus 600 may include one or more features of the window egress well apparatuses of any of the FIGS. 1-5C. As illustrated in FIG. 6A, in some embodiments, a ladder of the window well egress apparatus 600 may include a stationary section 602 and a sliding section 604. In some embodiments, the sliding section 604 may slide with respect to the stationary section 602 between a raised position and a lowered position and/or between the raised position and the lowered position. In some embodiments, an upper end of the stationary section 602 may be secured to a main grate 606, which may be configured to extend over a top of a window well structure.

In some embodiments, the main grate 606 may include a moveable subsection 608 that may move between an open and closed position. In some embodiments, the sliding section 604 may include one or more slide brackets 607, which may each include a channel 613 through which the stationary section 602 extends. Brackets 607 aligns the sliding section 604 and stationary section 602 during the sliding section's 604 actuation from the raised position to the lower position. As a result, slide brackets 607 may be positioned on either the stationary section 602 or the sliding section 604.

In some embodiments, an upper end of the sliding section 604 may include one or more catch elements 610, which may selectively secure the moveable subsection 608 in the closed position when the sliding section 604 is in the raised position. In some embodiments, the catch elements 610 may include pins, pegs, protrusions, clips, or other suitable elements which physically obstruct or block the moveable subsection's 608 movement. In some embodiments, in response to the actuation of the sliding section 604 sliding from the raised position to the lowered position, by, for example, a person actuating the sliding section 604 by stepping on or applying a downward force to the sliding section 604, the catch elements 610 may move below the moveable subsection 608, which may stop blocking the movable subsection 608 and allow it to move to the open position. When the moveable subsection 608 is in the open position, the person may exit the window well structure through an opening 609 in the main grate 606.

In some embodiments, the catch elements 610 may selectively secure the moveable subsection 608 in the closed position. In some embodiments, the moveable subsection 608 may automatically move to the open position in response to removal of the catch elements 610 from the path of the moveable subsection 608. In some embodiments, this automatic movement of the movable subsection 608 may be due to one or more springs, one or more weights, and/or another suitable mechanism that moves the moveable subsection 608 to the open position. In some embodiments, a mechanical system may include a cable, pulley, and weight, which may work collectively to apply an opening force on the moveable subsection 608 in response to movement of the catch elements 610 below the moveable subsection 608.

Alternatively the moveable subsection may be actuated by the user. In this embodiment the user may remove the catch elements 610 from the path of the movable subsection 608 by actuating the sliding section 604 and then manually slide the moveable subsection 610 to its open position.

Figure 6B:
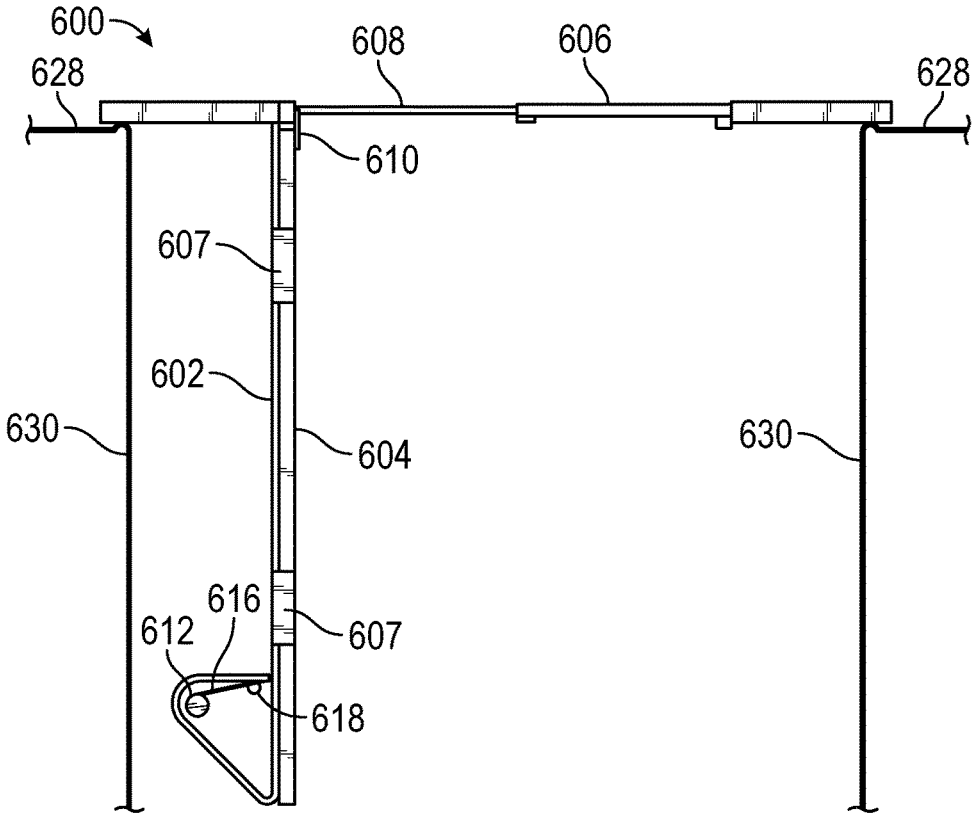
FIG. 6B is a side view of the window well egress apparatus of FIG. 6A, illustrating an example sliding section of an example ladder in a raised position and an example moveable subsection in a closed position, according to some embodiments.
Figure 6C:
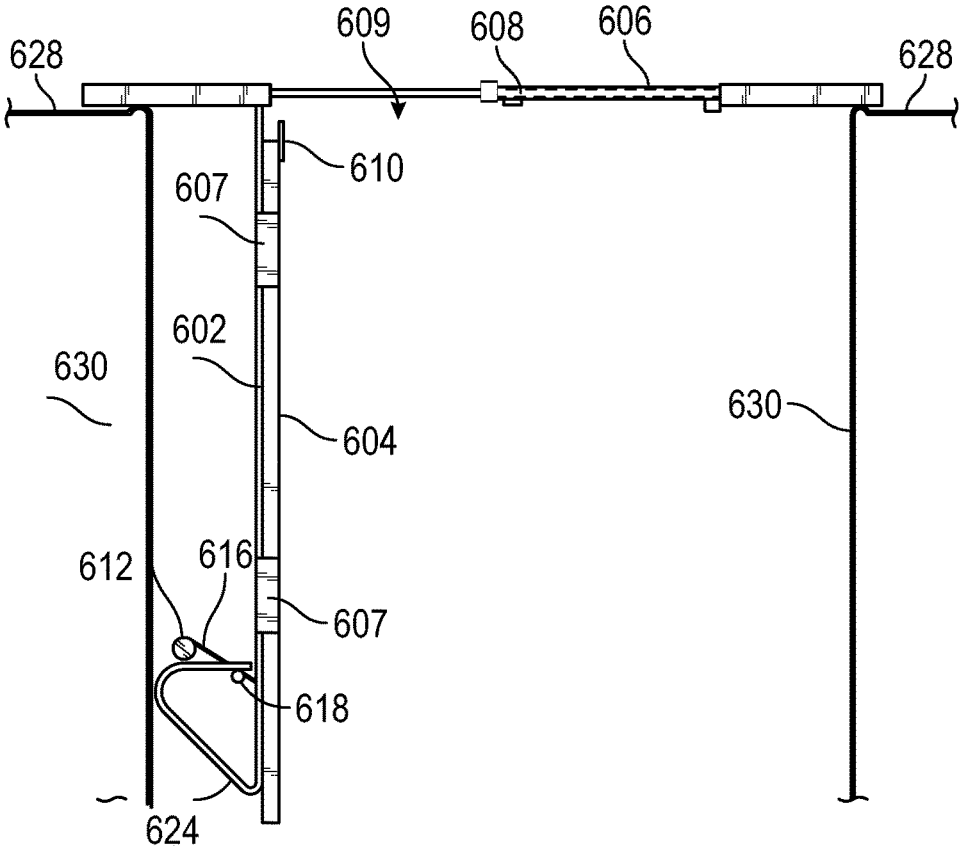
FIG. 6C a side view of the window well egress apparatus of FIG. 6A, illustrating the sliding section of the ladder in a lowered position and the moveable subsection in an open position, according to some embodiments.

FIG. 6B illustrates the sliding section 604 in the raised position and the moveable subsection 608 in the closed position, according to some embodiments. As illustrated in FIG. 6B, in some embodiments, the catch elements 610 may selectively hold the moveable subsection 608 in the closed position. However, as illustrated in FIG. 6C, in some embodiments, in response to the sliding section 604 being slid to the lowered position, the catch elements 610 may no longer prevent the moveable subsection 608 from moving to the open position. In some embodiments, one or more bars of the moveable subsection 608 may move into an open position. This open position may include one or more bars of the moveable subsection 608 may move into a cavity or recess of one or more bars of the main grate 606 when the moveable subsection 608 slides to the open position. Alternatively however, it is understood that, in some embodiments, the one or more bars of the moveable subsection 608 may move above, below, on a side, or another suitable position with respect to the one or more bars of the main grate 606. It is also understood that, in some embodiments, the moveable subsection 608 and/or the main grate 606 may include another configuration, which may not include bars.

As illustrated in FIGS. 6B-6C, in some embodiments, a weight 612 may be coupled to the sliding section 604. In some embodiments, the weight 612 and a rung bracket 614 may be separated by a plate 616, which may sit on top of a fulcrum 618 of the stationary section 602. In some embodiments the plate 616 may comprise a plurality of bars, rods, cables or any other structure known for use in a cantilever. In some embodiments, the plate 616 may pivot on the fulcrum 618 when the sliding section 604 slides between the raised position and the lowered position and/or between the lowered position and the raised position. In some embodiments, when the sliding section 604 slides to the lowered position, the weight 612 may be moved upwardly.

In some embodiments, when the sliding section 604 slides to the raised position, the weight 612 may be moved downwardly. In some embodiments, a particular rung 620 of the sliding section 600 may extend through the rung bracket 614 so the bracket 614 can freely rotate or pivot around the rung 620. In some embodiments, a particular counterweight element may include more than one weight 612 and/or rung bracket 614.

In some embodiments, the fulcrum 618 may be disposed behind one or more side rails 622 of the stationary section 602 of the ladder. In some embodiments, the fulcrum 618 may be disposed in various locations with respect to the side rails 602. In some embodiments, the fulcrum 618 may be directly coupled to the side rails 622.

Figure 6D:
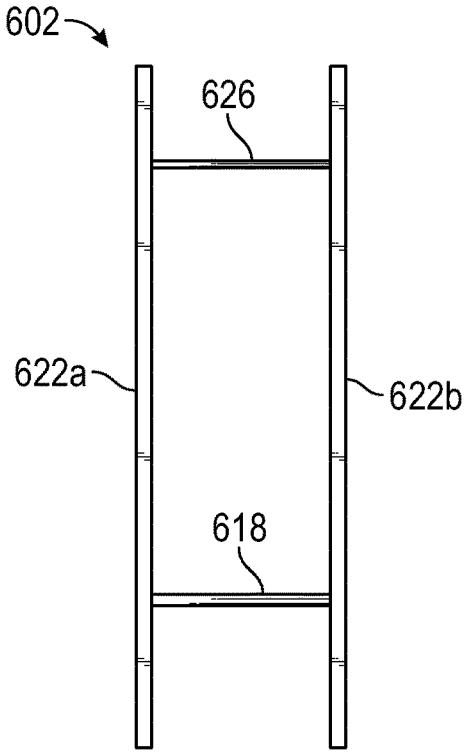
FIG. 6D is a front view of an example stationary section of the ladder of the window well egress apparatus of FIG. 6A, according to some embodiments.

As illustrated in FIG. 6D, in some embodiments, the side rails 622 may include a first side rail 622*a* and a second side rail 622*b* (which may be referred to collectively herein as "side rails 622"). In some embodiments, one or more support structures 624 may extend from the side rails 622, and the fulcrum 618 may be coupled to the support structures 624. In some embodiments, the support structures 624 may extend from the side rails 622 toward the window well structure.

In some embodiments the stationary section 602 comprises a main ladder support frame. In some embodiments the main ladder support frame comprises a plurality of coupling member, such as hooks, on the top of the frame to selectively engage the top of the frame to the lip of a window well. Alternatively, in some embodiments the stationary section's 602 coupling member may be coupled or selectively couple directly to the main grate 608. In some embodiments, the frame 602 may rest on the ground at the bottom of the window well. In some embodiments the frame may hang from a support, such as the top lip of the window well or the main grate. In some embodiments the frame 602 may lean at an angle or in some embodiments the frame 602 may hang substantially vertically.

In some embodiments the rails 622 of the main ladder support frame are substantially parallel and may be flat or round, the cross-sectional shape of the rails 622 are selected to nest within the sliding brackets 607 or channels 613. The bottom of the main latter support frame stationary section 602 The frame 602 comprises two parallel support rails which designed to be the width and length of a ladder that can fit inside a window well without resting on the ground or floor of the window well. Some embodiments may comprise dimensions approximately 1-2 feet wide and between 2.5 to 10 feet tall or more, depending on the dimensions of the window well.

In certain embodiments the main ladder support frame 602 may comprise any suitable material including plastic, composites, metal or any other suitable material or combination of materials. In certain embodiments plastic may present advantages to prevent icing. In other embodiments the base of the rails are curled around to create a support structure 624 which spaces the frame from the wall of a window well.

In some embodiments the two rails of the stationary section 602 are a fixed distance apart and are connected by a spacer bar at the top of the frame and a fulcrum bar 618 at the bottom of the frame. The fulcrum bar 618 is set back from the rail.

In some embodiments, a first support structure 625 may extend outwardly from the first side rail 622*a* and/or a second support structure 625 may extend outwardly from the second side rail 622*b*. In these and other embodiments, a first end of the fulcrum 618 may be coupled to the first support structure 624 and/or a second end of the fulcrum 618 may be coupled to the second support structure 624. In some embodiments, the stationary section 602 may include one or more braces 626 which may be coupled to the side rails 622. For example, a first end of a particular brace 626 may be coupled to the first side rail 622*a* and a second end of the particular brace 626 may be coupled to the second side rail 622*b*.

In some embodiments, the main grate 606 may rest on the ground 628. Additionally or alternatively, in some embodiments, the main grate 606 may be coupled to and/or sit on top of the window well structure 630, as illustrated, for example, in FIGS. 6B-6C.

Figure 6E:
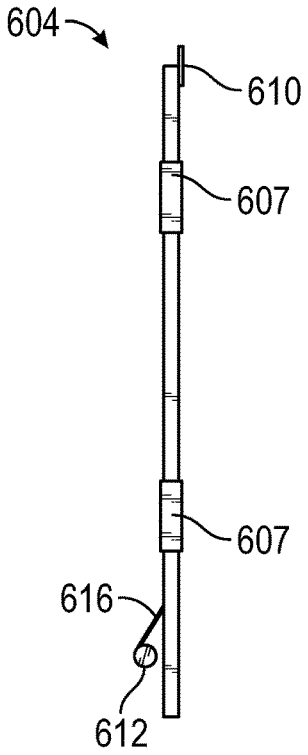
FIG. 6E is a side view of the sliding section of the ladder of the window well egress apparatus of FIG. 6A, according to some embodiments.
Figure 6F:
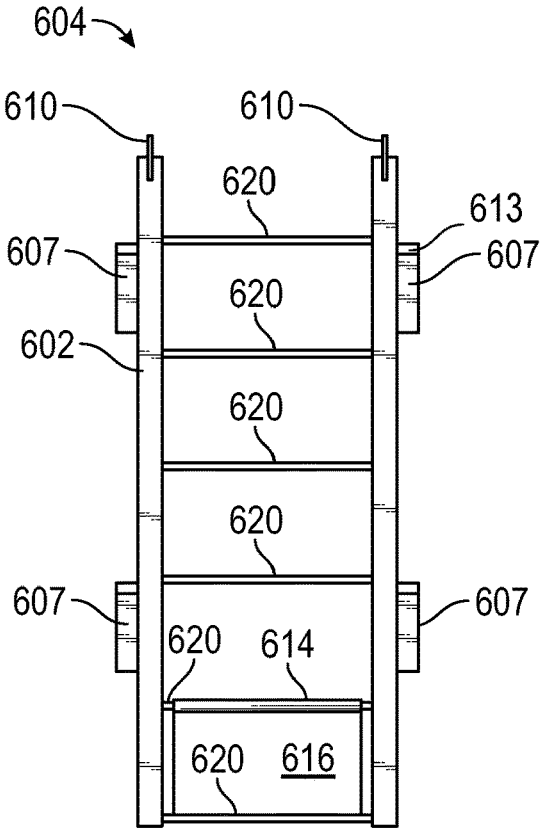
FIG. 6F is a front view of the sliding section of the ladder of the window well apparatus of FIG. 6A, according to some embodiments.

As illustrated in FIGS. 6E-6F, in some embodiments, when the sliding section 604, coupled with the weight 612, is removed from the stationary section 602, the counterweight element may not be supported by the fulcrum 618 and may move downwardly as the rung bracket 614 pivots around a particular rung 620 of the sliding section 604. FIGS. 6E-6F illustrate the sliding section 604 prior to assembly of the window well egress apparatus 600, according to some embodiments.

Figure 6G:
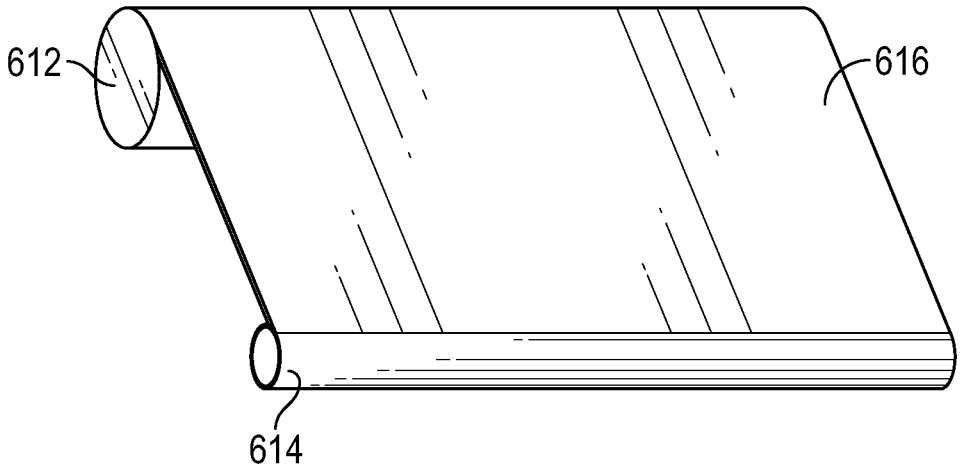
FIG. 6G is an upper perspective view of an example counterweight element of the window well apparatus of FIG. 6A, according to some embodiments.

FIG. 6G illustrates the rung bracket 614 connected to the weight 612 by the plate 616, according to some embodiments. In some embodiments, the plate 616 may have various configurations and shapes. In some embodiments, the plate 616 may be planar. In some embodiments, the rung bracket 614 may include a channel, which may be configured to receive a particular rung 620 of the sliding section 604. In some embodiments, the plate 616 may be supported by the fulcrum 618 and the rung bracket 614 may freely pivot around the particular rung 620 as the sliding section 604 slides to the raised position and/or the lowered position.

Figure 6H:
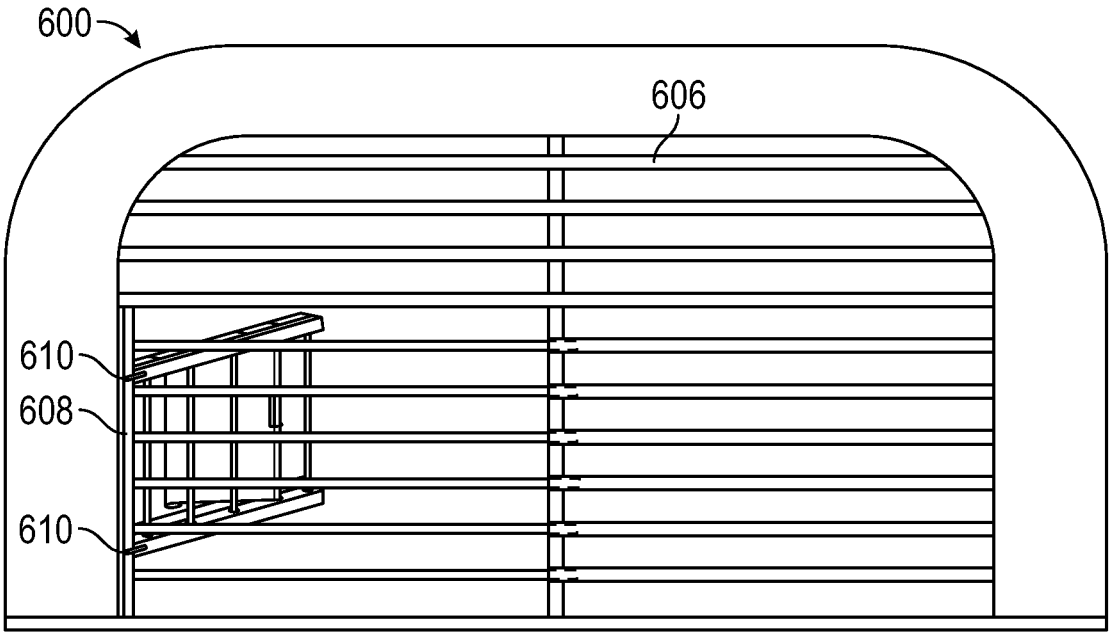
FIG. 6H is a top view of the window well egress apparatus of FIG. 6A, illustrating the sliding section of the ladder in the raised position and the moveable subsection in the closed position.
Figure 6I:
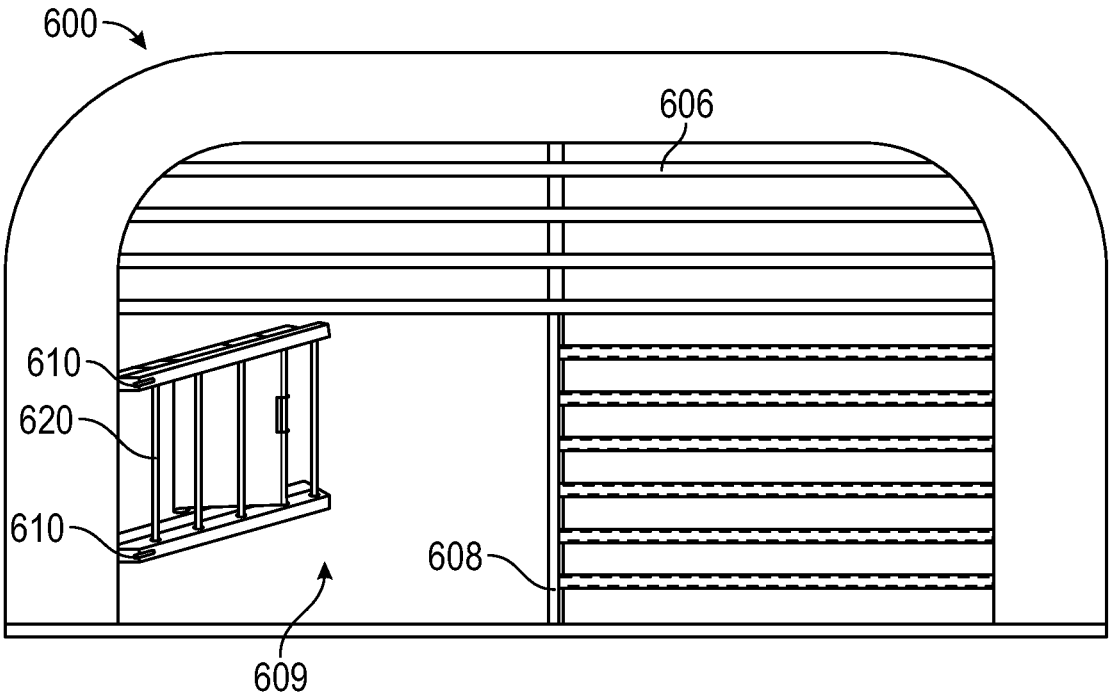
FIG. 6I is a top view, illustrating the sliding section of the ladder in the lowered position and the moveable subsection in the open position, according to some embodiments.

As illustrated in FIG. 6H, in some embodiments, when the moveable subsection 608 is in the closed position, the window well structure 628 may be secure from intruders. As illustrated in FIG. 6I, in some embodiments, the opening 609 may allow a person to exit and/or enter the window well structure 628. In some embodiments, the main grate 606 may be generally horizontally oriented with respect to the ground.

In closing, it is to be understood that the embodiments of the disclosure disclosed herein are illustrative of the principles of the present disclosure. Other modifications that may be employed are within the scope of the disclosure. Thus, by way of example, but not of limitation, alternative configurations of the present disclosure may be utilized in accordance with the teachings herein. Accordingly, the present disclosure is not limited to that precisely as shown and described.

The invention claimed is:

1. A window well egress apparatus, comprising:

a main grate;

a ladder coupled to the main grate, the ladder having a sliding section slidable between a raised position and a lowered position, wherein in response to the sliding section sliding to the lowered position, the main grate is opened;

wherein the sliding section comprises a rung; and further comprising a counterweight element, wherein the counterweight element comprises a rung bracket, wherein the rung of the ladder extends through the rung bracket and the counterweight element is configured to pivot around the rung.

2. The window well egress apparatus of claim 1, wherein the ladder further comprises a stationary section coupled to the main grate, wherein the sliding section is configured to slide along the stationary section.

3. The window well egress apparatus of claim 2, wherein the sliding section includes a slide bracket, wherein the stationary section extends through the slide bracket.

4. The window well egress apparatus of claim 2, wherein the stationary section further comprises a fulcrum that is configured to extend generally parallel to the rung.

5. The window well egress apparatus of claim 4, wherein the stationary section further comprises a support structure configured to extend outwardly from the stationary section away from the sliding section, wherein the fulcrum is coupled to the support structure.

6. The window well egress apparatus of claim 1, wherein the main grate comprises a moveable subsection, wherein the sliding section is configured to extend above a lower edge of the moveable subsection when the sliding section is in the raised position to prevent the moveable subsection from opening.

7. The window well egress apparatus of claim 6, wherein when the sliding section is in the lowered position, the sliding section is disposed below the lower edge of the moveable subsection to allow the moveable subsection to open.

8. The window well egress apparatus of claim 7, wherein the counterweight element further comprises a weight and a plate, wherein the weight is separated from the rung bracket by the plate, wherein the plate is configured to sit on top of a fulcrum.

* * * * *